US005369509A

United States Patent [19]

Ko

[11] Patent Number: 5,369,509

[45] Date of Patent: Nov. 29, 1994

[54] DOCUMENT TRANSFERRING SYSTEM FOR A FACSIMILE APPARATUS

[75] Inventor: Seok-Kyung Ko, Seoul, Rep. of Korea

[73] Assignee: Samsung Electronics Co., Ltd., Suwon, Rep. of Korea

[21] Appl. No.: 616

[22] Filed: Jan. 5, 1993

[30] Foreign Application Priority Data

Nov. 26, 1992 [KR] Rep. of Korea ..... 22449/1992

[51] Int. Cl.[5] ..... H04N 1/04

[52] U.S. Cl. ..... 358/498; 358/414; 358/496

[58] Field of Search ..... 358/498, 496, 474, 414; 355/321, 308, 75, 64, 271

[56] References Cited

U.S. PATENT DOCUMENTS

| | | | |
|---|---|---|---|
| 2,894,066 | 7/1959 | Buckingham | 358/498 |
| 4,326,222 | 4/1982 | Connin et al. | 358/498 |
| 4,638,987 | 1/1987 | Sakurai . | |
| 4,667,244 | 5/1987 | Ishikawa | 358/498 |
| 4,953,037 | 8/1990 | Ito et al. | 358/496 |
| 5,077,618 | 12/1991 | Sakai et al. | 358/498 |
| 5,118,090 | 6/1992 | Sonoda et al. | 271/10 |
| 5,153,750 | 10/1992 | Hiroi et al. | 358/498 |
| 5,155,603 | 10/1992 | Seok-Jae | 358/498 |
| 5,157,520 | 10/1992 | Tanaka et al. | 358/498 |
| 5,239,395 | 8/1993 | Kang et al. | 358/498 |
| 5,270,841 | 12/1993 | Watanabe | 358/498 |

*Primary Examiner*—Edward L. Coles, Sr.
*Assistant Examiner*—Madeleine Anh-Vinh Nguyen
*Attorney, Agent, or Firm*—Robert E. Bushnell

[57] ABSTRACT

A document transferring system used in a facsimile apparatus or document scanner includes a first drive gear directly connected to a motor, an idler gear engaged with the first drive gear, a second drive gear engaged with the idler gear for driving a feed roller, and a third drive gear engaged with the second drive gear for driving a pressure roller. The idler gear may be configured as a double gear with large and small toothed wheels respectively engaging the first and second drive gears.

25 Claims, 4 Drawing Sheets

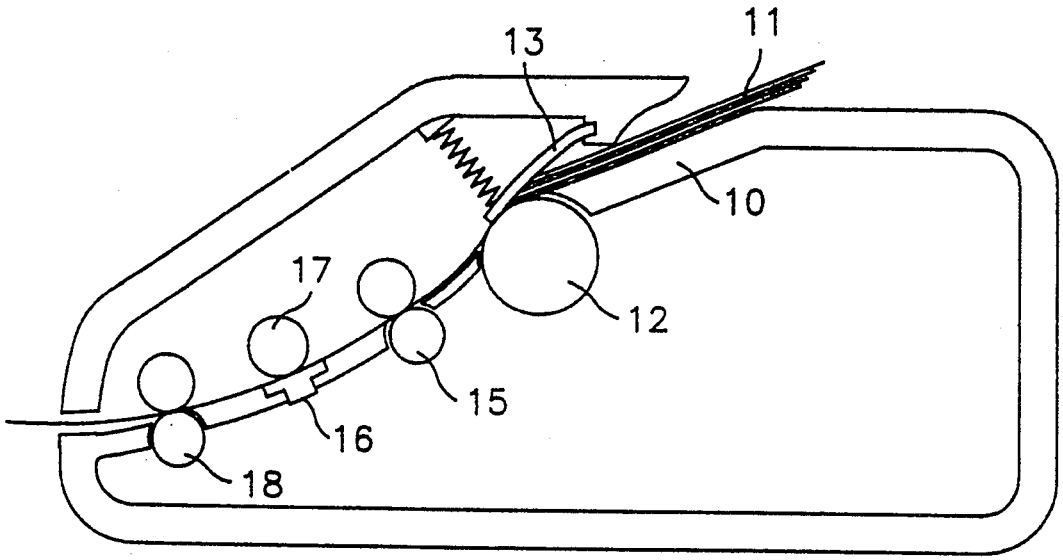
CONVENTIONAL
*FIG. 1*

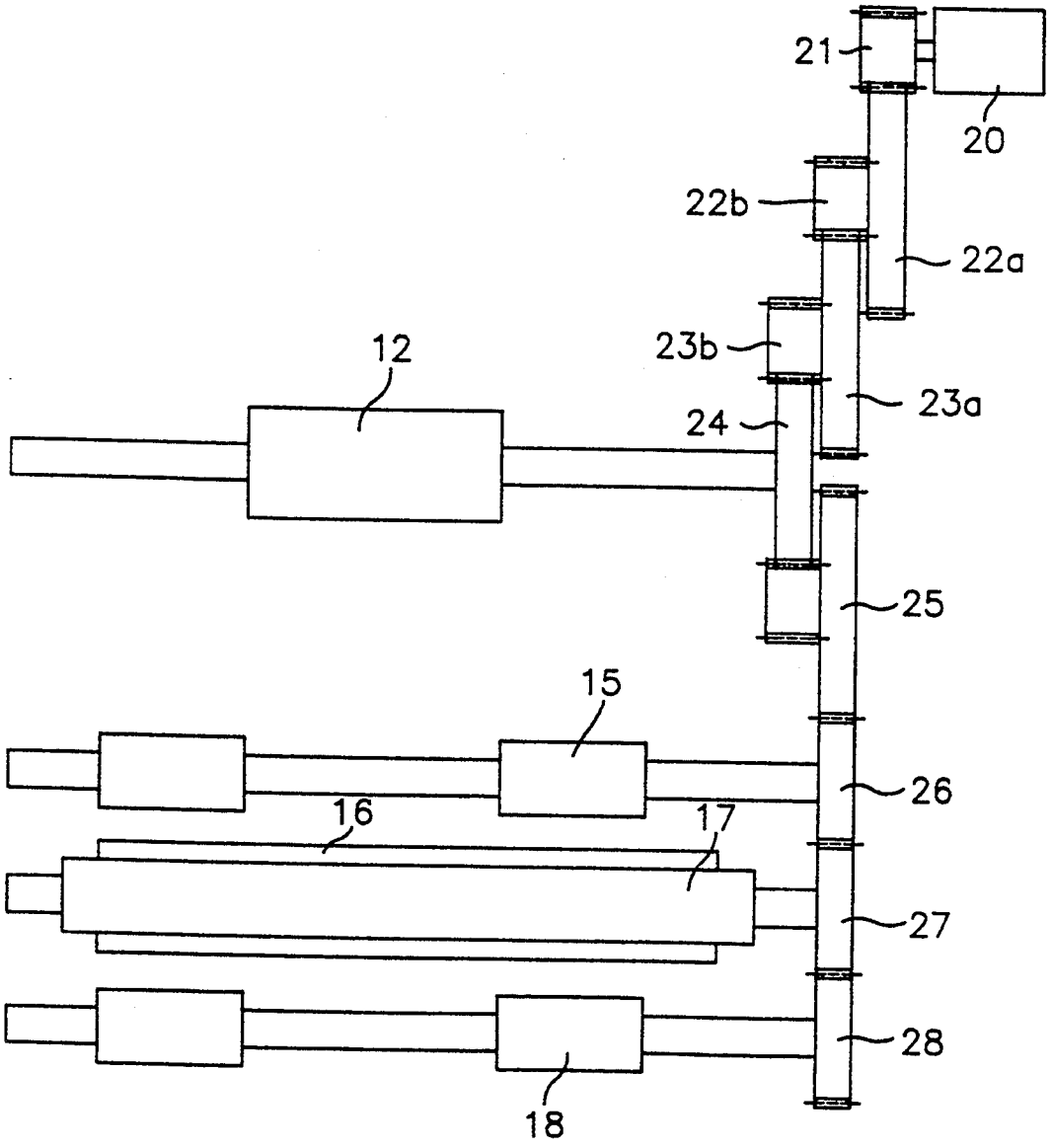
CONVENTIONAL
*FIG. 2A*

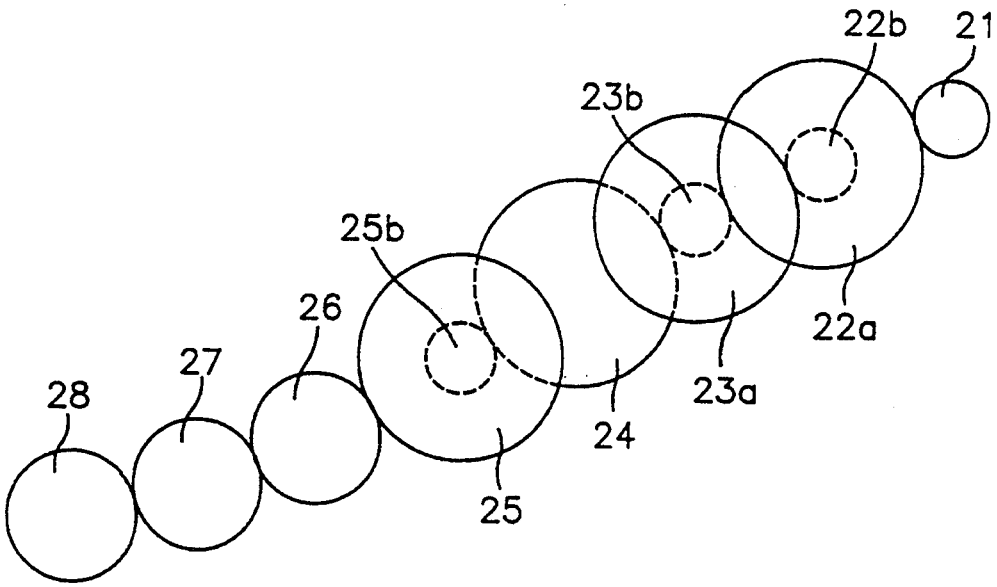
CONVENTIONAL
*FIG. 2B*

DOCUMENT TRANSFERRING SYSTEM FOR A FACSIMILE APPARATUS

FIELD OF THE INVENTION

The present invention relates to a document transferring system for a facsimile apparatus, and more particularly, to the gear and roller structure and process for transferring documents through the system.

BACKGROUND OF THE INVENTION

Conventionally, facsimile apparatus contains both signal transmission and signal reception sections. The structure of the signal transmission section includes feed rollers for feeding a number of documents one by one to a predetermined station inside the apparatus, transfer rollers for transferring the documents fed by the feed rollers, and pressure rollers for closely contacting the surfaces of the documents with an image sensor for scanning the information recorded on the documents. The structure of the signal receiving section includes transfer rollers for transferring heat-sensitive paper, a thermal print head for thermally recording received data on the heat-sensitive paper, a cutter for cutting the heat-sensitive paper to the amount of the received data, and discharge means for discharging the cut paper.

In designs of document feeders used in the signal transmission section the document should be in exceptionally close contact with an image sensor because any gap existing between the image sensor and the document causes a lack of focus of the image sensor to result in an unclear reproduced image. Consequently, a pressure roller is required to press documents against the image sensor.

Moreover, the gear structure of designs for conventional document feeders comprises a drive gear directly connected with a motor for driving a series of idler gears engaged with a feed gear for driving a feed roller. Additionally, a first transfer gear is connected with the feed gear via an idler gear for driving a first transfer roller while an idler gear is to rotate the first transfer roller in the same direction as the feed roller and increase the line speed of the first transfer roller. The first transfer gear is engaged with a pressure gear to drive a pressure roller. The pressure gear is in turn engaged with a second transfer gear to drive a second transfer roller. Thus, the gear and roller structure is made unduly complicated in order to reduce the bulk of the facsimile apparatus. Furthermore, the rotational speeds of the first transfer roller, pressure roller and second transfer roller should be the same.

U.S. Pat. No. 5,077,618 issued Dec. 31, 1991 to Sakai et. al. simplifies a facsimile apparatus by providing a single conveyor roller, i.e. pressure roller, above which an image sensor is set and below which a printing head is set. The apparatus provides a document transferring system which includes: feeding rollers; a single pressure roller driven from a motor via a first drive gear, a reduction gear and a second drive gear; and discharge rollers. The gear configuration for driving the feeder rollers and the discharge rollers is not disclosed.

The present invention simplifies the document transferring system of Sakai et. al. by requiring fewer components, thus improving efficiency and saving manufacturing costs, replacement pan costs, and maintenance costs.

SUMMARY OF THE INVENTION

It is therefore, one object to provide an imposed gear structure and process for document transfer in a facsimile apparatus.

It is another object to reduce the bulk of a facsimile apparatus by simplifying the gear structure and process for document transfer within a document scanning or facsimile telecommunication system.

It is yet another object to improve the power transmission efficiency of a motor used in a facsimile or document scanning apparatus.

These and other objects may be achieved according to the principles of the present invention with a document transferring system used in a facsimile apparatus using a first drive gear directly connected with a motor, an idler gear engaged with the first drive gear, a second drive gear engaged with the idler gear for driving a feed roller, and a third drive gear engaged with the second drive gear for driving a pressure roller.

In one aspect of the present invention, the idler gear consists of a double gear with large and small toothed wheels respectively engaged with the first and second drive gears.

The present invention will now be described more specifically with reference to the drawings attached only by way of example.

BRIEF DESCRIPTION OF THE ATTACHED DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 1 is a schematic diagram of the structure of a conventional document feeder;

FIGS. 2A and 2B are schematic diagrams of the gear structure of FIG. 1;

DETAILED DESCRIPTION OF A PREFERRED EMBODIMENT

Figure 3:
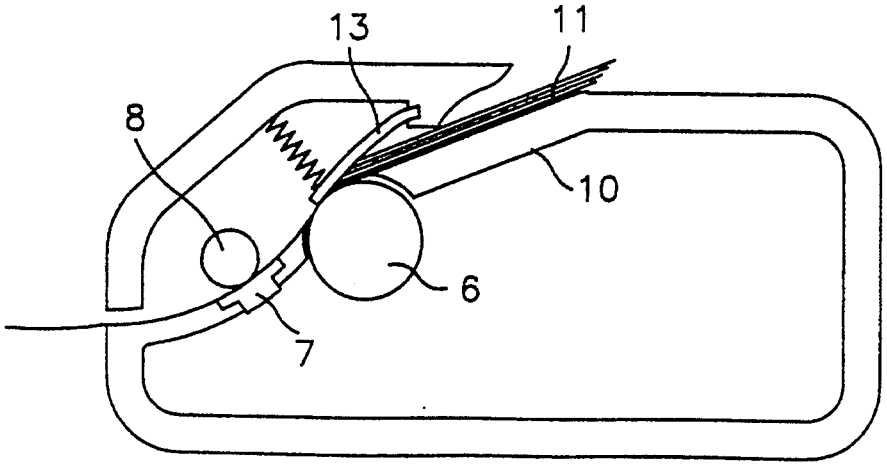
FIG. 3 is a schematic diagram of the structure of a document transferring system according to the present invention.

Turning now to the drawings, FIG. 1 shows a conventional document feeder used in the signal transmission section. Documents 11 guided by the guide 10 are fed one by one from the bottom by the cooperation of the feed roller 12 and rubber plate 13, then transferred by the transfer roller 15 to the image sensor 16 to convert the information on the transferred document into electrical signals stored into a memory device. In this design, the document should be closely contacted with the image sensor 16 because any gap existing between the image sensor 16 and the document causes unfocussing of the image sensor to result in an unclear reproduced image. The pressure roller 17 closely contacts the document 11 with the image sensor 16.

The gear structure of the conventional document feeder comprises, as shown in FIG. 2, a drive gear 21 directly connected with a motor 20 for driving a series of idler gears 22, 23 engaged with a feed gear 24 for driving a feed roller 12, and a first transfer gear 26 connected with the feed gear 24 via an idler gear 25 for driving a first transfer roller 15. The idler gear 25 is to rotate the first transfer roller 15 in the same direction as the feed roller 12 and increase the line speed of the first transfer roller 15. The first transfer gear 26 is engaged with a pressure gear 27 to drive a pressure roller 17. The pressure gear 27 is in turn engaged with a second transfer gear 28 to drive a second transfer roller 18. In this case, it is required that the rotational speeds of the first transfer roller 15, pressure roller 17 and second transfer roller 18 should be the same. Thus, the gear and roller structure is complicated to reduce the bulk of the facsimile apparatus.

Turning now to FIG. 3, a document transferring system according to the present invention includes a feed roller 6 which transfers a bottom sheet of documents 11, from the guide 10 with the cooperation of rubber plate 13, to image sensor 7 which conveys the information on the transferred document into electrical signals stored into a memory device (not shown). The pressure roller 8 provides a dual-function of first, applying pressure to the transferred document against the image sensor 7 so that a clear image is reproduced and second, discharging the transferred document from the facsimile apparatus.

Figure 4A:
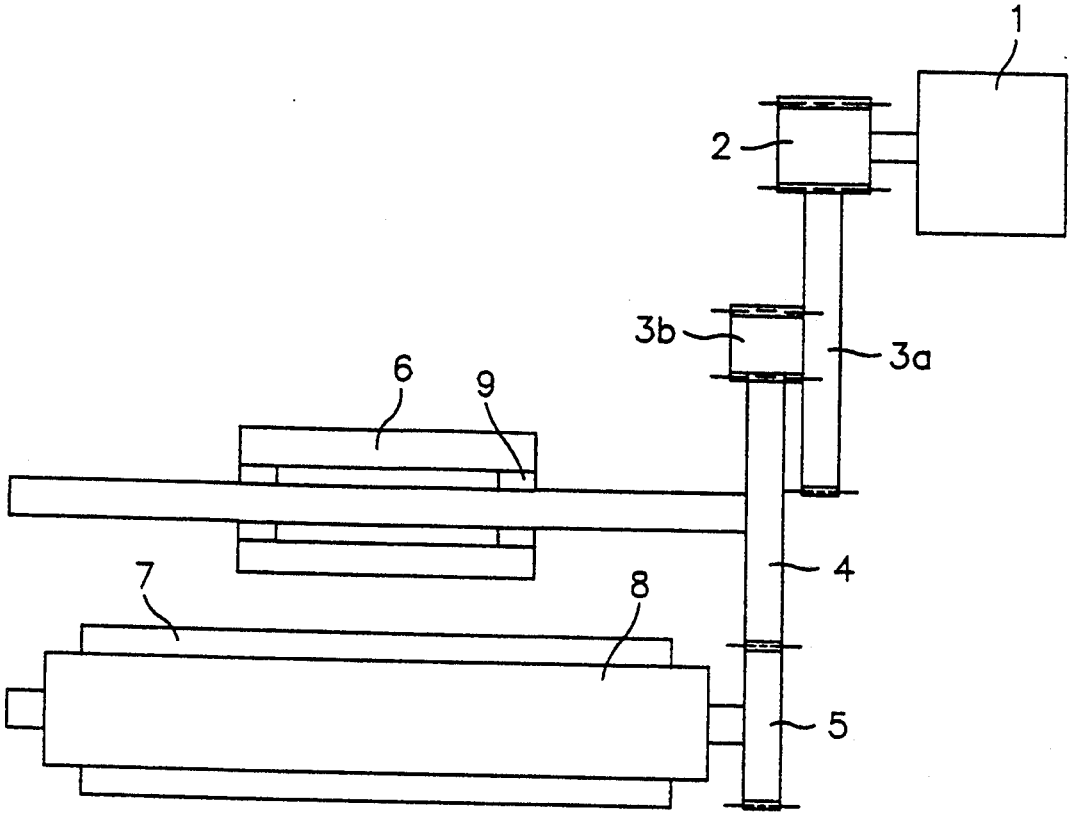
FIGS. 4A and 4B are schematic diagrams of the gear structure of FIG. 3.
Figure 4B:
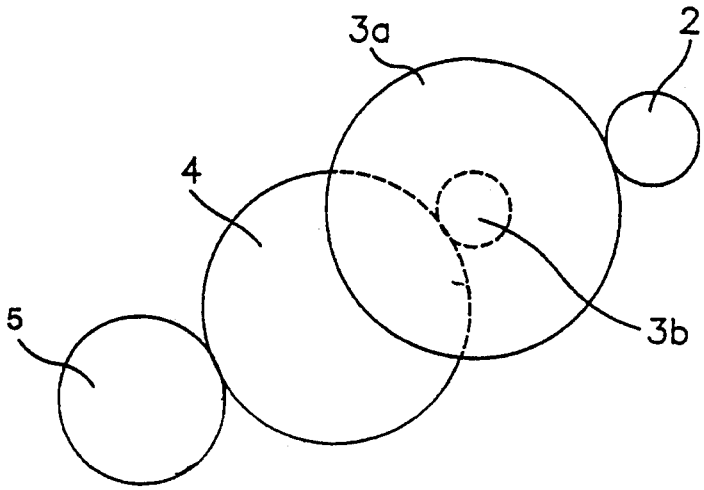

Referring to now to FIGS. 4A and 4B, a first drive gear 2 is directly connected with a motor 1, and engages an idler gear 3, which in turn is engaged with a second drive gear 4 for driving a feed roller 6. The idler gear 3 consists of a double gear with large and small toothed wheels 3*a* and 3*b* respectively engaged with the first and second drive gears 2 and 4. A third drive gear 5 is engaged with the second drive gear 4 for driving a pressure roller 8. The feed roller 6 is provided with a unidirectional clutch 9.

The third drive gear 5 is made to have a smaller diameter than the second drive gear 4, so that the pressure roller 8 may have a higher rotational speed than the feed roller 6.

In operation, when the first drive gear 2 drives the second drive gear 4 through the idler gear 3, the feed roller 6 is rotated to feed the documents loaded in the guide 10 one by one starting from the bottom in cooperation with the rubber plate 13. The line speed of the large toothed wheel 3*a* is reduced via the small toothed wheel 3*b* transmitted to the second drive gear 4. Consequently the third drive gear 5 is driven to rotate the pressure roller 8 to move the document 11 fed by the feed roller 6 and closely contacting the image sensor 7. At the same time the image sensor 7 scans the 30 information recorded on the document 11.

The line speed (and rotational speed) of the pressure roller 8 is greater than that of the feed roller 6 and thus the trailing end of the document tends to reverse the feed roller 6, but the unidirectional clutch 9 prevents this phenomenon. After the trailing end of the document has passed the feed roller 6, the document is discharged from the facsimile apparatus by the rotation of the pressure roller 8.

As stated above, the gear and roller structure of the document feeder is simplified to improve the functional reliability and power transmission efficiency.

What is claimed is:

1. A document transferring system used in a facsimile apparatus, said system comprising:

an image sensor for operating upon information borne by a document:

a first shaft;

a feed roller coaxially mounted on said first shaft and disposed to introduce the document into the facsimile apparatus;

a first drive gear directly connected to a motor;

idler gear means directly engaged with said first drive gear, for transferring rotational power from said first drive gear to a second drive gear directly engaged with said idler gear means, said second drive gear rotating concentrically with said first shaft to drive said feed roller;

a second shaft;

a pressure roller coaxially mounted on said second shaft and positioned to concurrently receive the document from said feed roller, apply the document to said image sensor, and discharge the document from the facsimile apparatus; and a third drive gear directly engaging said second drive gear, said third drive gear rotating concentrically with said second shaft to drive said pressure roller.

2. The document feeder of claim 1, wherein said idler gear means comprises a double gear having large and small toothed wheels respectively engaged with said first and second drive gears.

3. The facsimile apparatus of claim of wherein:

said first drive gear and said idler gear means having the large toothed wheel rotate in a first plane, and said second drive gear, said third drive gear and said idler gear means having the small toothed wheel rotate in a second plane.

4. The document feeder of claim 1, further comprising a unidirectional clutch engaging said feed roller with said second drive gear via said first shaft.

5. The facsimile apparatus of claim 1, wherein a diameter of the second drive gear is greater than a diameter of the third drive gear, providing a rotational speed of the pressure roller greater than a rotational speed of the feed roller.

6. The facsimile apparatus of claim 1, wherein said document is fed into the facsimile apparatus by the feed roller from a bottom of a pile of documents.

7. A facsimile device comprising an image sensor for operating upon information borne by a document, a motor and a document transferring system, said document transferring system comprising:

a first shaft;

a feed roller coaxially mounted on said first shaft and disposed to introduce the document into the facsimile device;

a first drive gear directly connected to the motor;

an idler gear engaged with said first drive gear;

a second drive gear engaged with said idler gear, said second drive gear rotating concentrically with said first shaft to drive said feed roller;

a second shaft;

a pressure roller coaxially mounted on said second shaft and positioned to concurrently receive the document from said feed roller, apply the document to said image sensor, and discharge the document from the facsimile device; and a third drive gear, engaged with said second drive gear, said third drive gear rotating concentrically with said second shaft to drive said pressure roller.

8. The facsimile device of claim 4, wherein said idler gear consists of a double gear comprising a large toothed wheel engaged with said first drive gear and a small toothed wheel engaged with said second drive gear, a diameter of the large toothed wheel being greater than a diameter of the small toothed wheel.

9. The facsimile device of claim 8, wherein:

said first drive gear and said idler gear having the large toothed wheel rotate in a first plane, and said second drive gear, said third drive gear and said idler gear having the small toothed wheel rotate in a second plane.

10. The facsimile device of claim 7, further comprising a unidirectional clutch for feeding the document into the facsimile device by engaging the feed roller with the second drive gear, and for preventing direction reversal of the feed roller.

11. The facsimile device of claim 4, wherein a diameter of the, second drive gear is greater than a diameter of the third drive gear, providing a rotational speed of the pressure roller greater than a rotational speed of the feed roller.

12. The facsimile apparatus of claim 7, wherein said document is fed into the facsimile apparatus by the feed roller from a bottom of a pile of documents.

13. A method of feeding a document into a facsimile device the steps comprising:

driving a first drive gear via a motor, said first drive gear being directly connected to said motor;

driving an idler gear directly engaged with said first drive gear by transferring rotational power from said motor to said idler gear;

rotating a feed roller coaxially mounted on a first shaft by driving a second drive gear directly engaging said idler gear, said feed roller rotating concentrically with said second drive gear about said first shaft to introduce a document into the facsimile device; and rotating a pressure roller coaxially mounted on a second shaft by driving a third drive gear directly engaged with said second drive gear, said pressure roller rotating concentrically with said third drive gear about said second shaft to concurrently receive the document from said feed roller, maintain contact between the document and the image sensor, and discharge the document from the facsimile device.

14. The method of claim 13, wherein said idler gear consists of a double gear comprising a large toothed wheel engaged with said first drive gear and a small toothed wheel engaged with said second drive gear, a diameter of the large toothed wheel being greater than a diameter of the small toothed wheel.

15. The method of claim 13, wherein said first drive gear and said idler gear having the large toothed wheel rotate in a first plane, and said second drive gear, said third drive gear and said idler gear having the small toothed wheel rotate in a second plane.

16. The method of claim 13, wherein the step of driving the second gear further comprises causing the feed roller to feed the document by engaging a unidirectional clutch for preventing direction reversal of the feed roller.

17. The method of claim 13, wherein a diameter of the second drive gear is greater than a diameter of the third drive gear, providing a rotational speed of the pressure roller greater than a rotational speed of the feed roller.

18. The method of claim 3, wherein said document is fed into the facsimile apparatus by the feed roller from a bottom of a pile of documents.

19. A method of feeding a document into a facsimile device, comprising the steps of:

driving a first drive gear via a motor, said first drive gear directly engaging said motor;

driving an idler gear directly engaging said first drive gear by transferring rotational power from said motor to said idler gear;

rotating a feed roller coaxially mounted on a first shaft by driving a second drive gear directly engaged with said idler gear, said feed roller rotating concentrically with said second drive gear about said first shaft to introduce the document into the facsimile device; and rotating a pressure roller coaxially mounted on a second shaft by driving a third drive gear directly engaging said second drive gear to enable said pressure roller to rotate concentrically with said third drive gear about said second shaft and to concurrently receive the document from said feed roller, maintain contact between the document and the image sensor, and discharge the document from the facsimile device.

20. The method of claim 19, wherein said idler gear is comprised of a double gear having a large toothed wheel engaged with said first drive gear and a small toothed wheel engaged with said second drive gear, a diameter of the large toothed wheel being greater than a diameter of the small toothed wheel.

21. The method of claim 20, wherein said first drive gear and said idler gear having the large toothed wheel rotate in a first plane, and said second drive gear, said third drive gear and said idler gear having tile small toothed wheel rotate in a second plane.

22. The method of claim 19, wherein the step of driving the second gear further comprises causing the feed roller to feed the document by engaging a unidirectional clutch for preventing direction reversal of the feed roller.

23. The method of claim 19, wherein a diameter of the second drive gear is greater than a diameter of the third drive gear, providing a rotational speed of the pressure roller greater than a rotational speed of the feed roller.

24. The method of claim 19, wherein said document is fed into the facsimile apparatus by the feed roller from a bottom of a pile of documents.

25. A facsimile device comprising an image sensor means for interchanging information with sheets of a printable medium, a motor and a document transferring system, said document transferring system comprising:

a first shaft;

a feed roller coaxially mounted on said first shaft and disposed while exhibiting a rotational direction to introduce the medium into the facsimile device;

a first drive gear directly connected to the motor;

idler gear means having a larger toothed wheel directly engaging said first drive gear and a smaller toothed wheel, said idler gear means for transferring rotational power from said first drive gear to a second drive gear, a diameter of the larger toothed wheel being greater than a diameter of the smaller toothed wheel;

said first drive gear and said larger toothed wheel rotating in a first plane;

said second drive gear directly engaging said smaller toothed wheel, said second drive gear rotating concentrically with said first shaft to drive said feed roller;

a second shaft;

a pressure roller coaxially mounted on said second shaft and positioned to concurrently receive the medium from said feed roller, apply the medium to said image sensor, and discharge the medium from the facsimile device;

a third drive gear engaged with said second drive gear, said third drive gear rotating concentrically with said second shaft to drive said pressure roller, said second drive gear having a diameter greater than a diameter of the third drive gear for providing a rotational speed of the pressure roller greater than a rotational speed of the feed roller;

said second drive gear, said third drive gear and said smaller toothed wheel rotating in a second plane; and a unidirectional clutch engaging said feed roller with the second drive gear via said first shaft for preventing reversal of said rotational direction of said feed roller.

* * * * *

UNITED STATES PATENT AND TRADEMARK OFFICE

CERTIFICATE OF CORRECTION

PATENT NO. : 5,369,509
DATED : November 29, 1994
INVENTOR(S) : Seok-Kyung Ko

It is certified that error appears in the above-indentified patent and that said Letters Patent is hereby corrected as shown below:

IN THE CLAIMS

| | |
|---|---|
| Claim 3 | Column 4, Line 24, before "wherein" change "of" to – 2, –; |
| Claim 8 | Column 4, Line 63, change "4" to --7--; |
| Claim 11 | Column 5, Line 12, change "4" to --7--; |
| Claim 18 | Column 5, Line 64, change "3" to --13--; |
| Claim 21 | Column 6, Line 31, change "tile" to --the--: |

Signed and Sealed this
Fourth Day of March, 1997

*Attest:*

*Attesting Officer*

Bruce Lehman

BRUCE LEHMAN

*Commissioner of Patents and Trademarks*